United States Patent [19]

Bugarcic

[11] 4,233,904

[45] Nov. 18, 1980

[54] ASYMMETRICAL SUBWAY VEHICLE

[75] Inventor: Helmut Bugarcic, Hamburg, Fed. Rep. of Germany

[73] Assignee: Waggon Union GmbH, Fed. Rep. of Germany

[21] Appl. No.: 951,035

[22] Filed: Oct. 13, 1978

[30] Foreign Application Priority Data

Oct. 21, 1977 [DE] Fed. Rep. of Germany ..... 2747286

[51] Int. Cl.[3] ..... B61B 13/10; B61D 1/04; B61D 17/00; B61D 19/02

[52] U.S. Cl. ..... 104/138 R; 105/329 R; 105/397

[58] Field of Search ..... 104/138 R; 105/141, 105/144, 329 R, 397

[56] References Cited

U.S. PATENT DOCUMENTS

| | | | |
|---|---|---|---|
| 185,122 | 12/1876 | Montgomery | 105/144 X |
| 466,364 | 1/1892 | Paige | 105/144 |
| 1,201,429 | 10/1916 | Bager | 105/144 |
| 3,403,634 | 10/1968 | Crowder | 104/138 R |
| 3,890,904 | 6/1975 | Edwards | 105/144 X |

*Primary Examiner*—Howard Beltran
*Attorney, Agent, or Firm*—McGlew and Tuttle

[57] ABSTRACT

A subway vehicle for service in a tunnel which has a circular cross-section, wherein, a car body having an asymmetrical cross-section with a first longitudinal side having a vertical side wall with the necessary windows and doors in this vertical side wall and having an opposite second longitudinal side which conforms to the configuration of the tunnel for travel therethrough. The car body has an inner wall spaced from the opposite second longitudinal side and the space between this inner wall and the opposite first longitudinal side defines the passenger space. The inner wall does not contain any windows. In addition, the space between the inner wall and the outer second longitudinal side defines a utility compartment space between the opposite second longitudinal side wall and the inner longitudinal wall for accommodating air, heating, and cable channels.

2 Claims, 4 Drawing Figures

ASYMMETRICAL SUBWAY VEHICLE

FIELD AND BACKGROUND OF THE INVENTION

This invention relates in general to rail vehicles and, in particular, to a new and useful subway vehicle for service in a tunnel or tunnel tube, having a circular or rounded cross-section, with the car body of the vehicle having an unsymmetrical cross-section and one of its longitudinal sides formed by a vertical side wall which is provided with the necessary windows and doors, while the roof and the other longitudinal side of the vehicle are substantially conformed to the cross-section of the tunnel or tunnel tube.

DESCRIPTION OF THE PRIOR ART

To bring into practice a fully automatic urban rapid transit system of driverless operation, it must be insured, in the first place, that the brake command signals originating in the train safety and control devices stop the train within a provided distance with maximum security. Further, the predetermined acceleration ad deceleration values must be reliably observed to the effect of an economical and comfortable operation.

Since the adhesion between wheel and rail on a free track section is very irregular, depending on the ambient air conditions, the requirements of safety and performance can be met with the necessary reliability only if the tunnel construction is well ventilated.

These conditions, in connection with minimized overall dimensions and costs of construction of such weather-protected tracks, lead to the provision of tubes which have a small cross-section and may be prefabricated.

With a minimum tunnel cross-section thus available, the concept of the vehicle must comply with all of the requirements placed on the capacity and reliability of the vehicle, on dimensions of the functional spaces, seats, standing room and door room. These requirements lead to the design of a car body having an unsymmetrical cross-section, in connection with a small track gauge, and ensuring the best utilization of the tunnel tube space and, at the same time, a safe emergency exit from the vehicle and escape foot path through the tunnel. The clearance needed for the vehicle may be quite considerably reduced by reducing the diameter of the wheels and lowering the floor of the passenger space between the car trucks, so that with a relatively small tunnel diameter, the spatial comfort and smooth traffic of passengers can be ensured.

With this concept of the vehicle, a utilization of the available space to the largest extent for the passenger accommodation necessarily results in problems of placing the channels for cables and air and heating conduits. A placing of these channels in the floor or roof, as quite usual in rail vehicles, is not practicable in this case since due to the tubular construction and the lowered floor, the necessary space cannot be found in the roof or floor zones.

SUMMARY OF THE INVENTION

The present invention is directed to a subway vehicle of the above-mentioned kind in which it is possible to arrange the required channels for cables and air and heating conduits in a manner which is simple in structure and economical, with an optimum utilization of the available cross-section for the passenger space.

In accordance with the invention, it is provided that the channels for cables, air, and heating are provided at the longitudinal vehicle side conformed to the tunnel, outside of the passenger space, and that this longitudinal vehicle side is devoid of windows and doors. The middle zone of the longitudinal vehicle side which conforms in cross-section to the tunnel tube cannot be appropriately used for enlarging the passenger space. Further, in order to reduce the cross-section of the tunnel or tunnel tube as much as possible, it is advantageous to provide escape paths on both sides of the tunnel. Windows and doors on one longitudinal side of the vehicle may advantageously be omitted. The central portion of the vehicle cross-section on this longitudinal side may thus advantageously be used for arranging the channels for cables, air and heating.

In accordance with another embodiment of the invention, the side wall of the longitudinal vehicle side having no windows or doors extends in the vertical direction and carries a structural element containing the channels which is conformable, on one of its sides, to the shape of the tunnel. In this embodiment, the channels may advantageously be provided in a prefabricated structural element. The element may be assembled in advance and then secured to the car body.

Accordingly, it is an object of the invention to provide and improved subway vehicle or car, for service in a tunnel or tunnel tube, which has a circular or rounded cross-section and which comprises a car body having an unsymmetrical cross-section with a first side being substantially vertical and having the necessary windows and doors and having an opposite second longitudinal side which is of a configuration conforming to the curvature of the tunnel and, wherein, the space between the outer longitudinal side which is curved to the configuration of the tunnel and an inner longitudinal wall of the train, forms a utility space for accommodating one or more air and heating ducts or cable ducts.

A further object of the invention is to provide a subway vehicle which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 2:
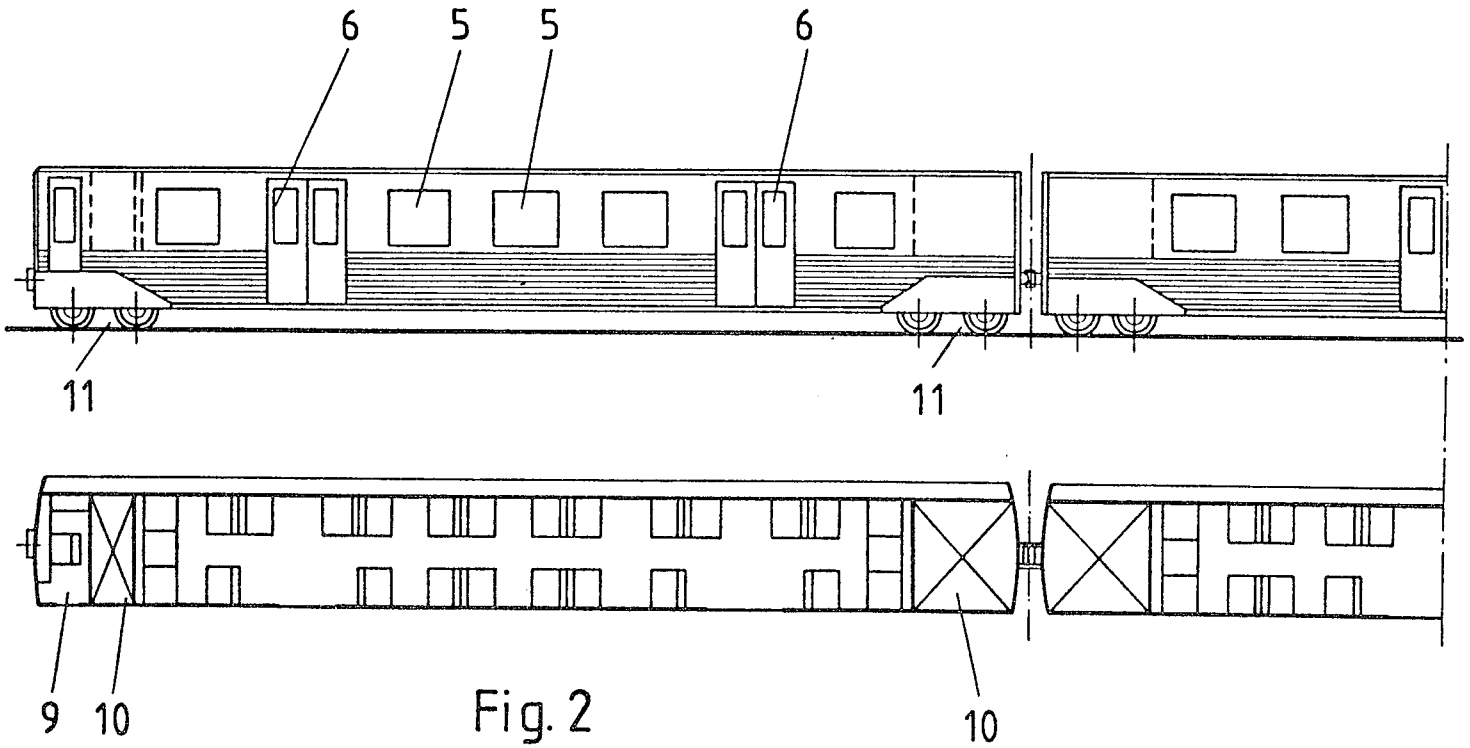
FIG. 1 is a side elevational view of a subway vehicle constructed in accordance with the invention.
FIG. 2 is a diagrammatical top plan view of the vehicle shown in FIG. 1.
Figure 3:
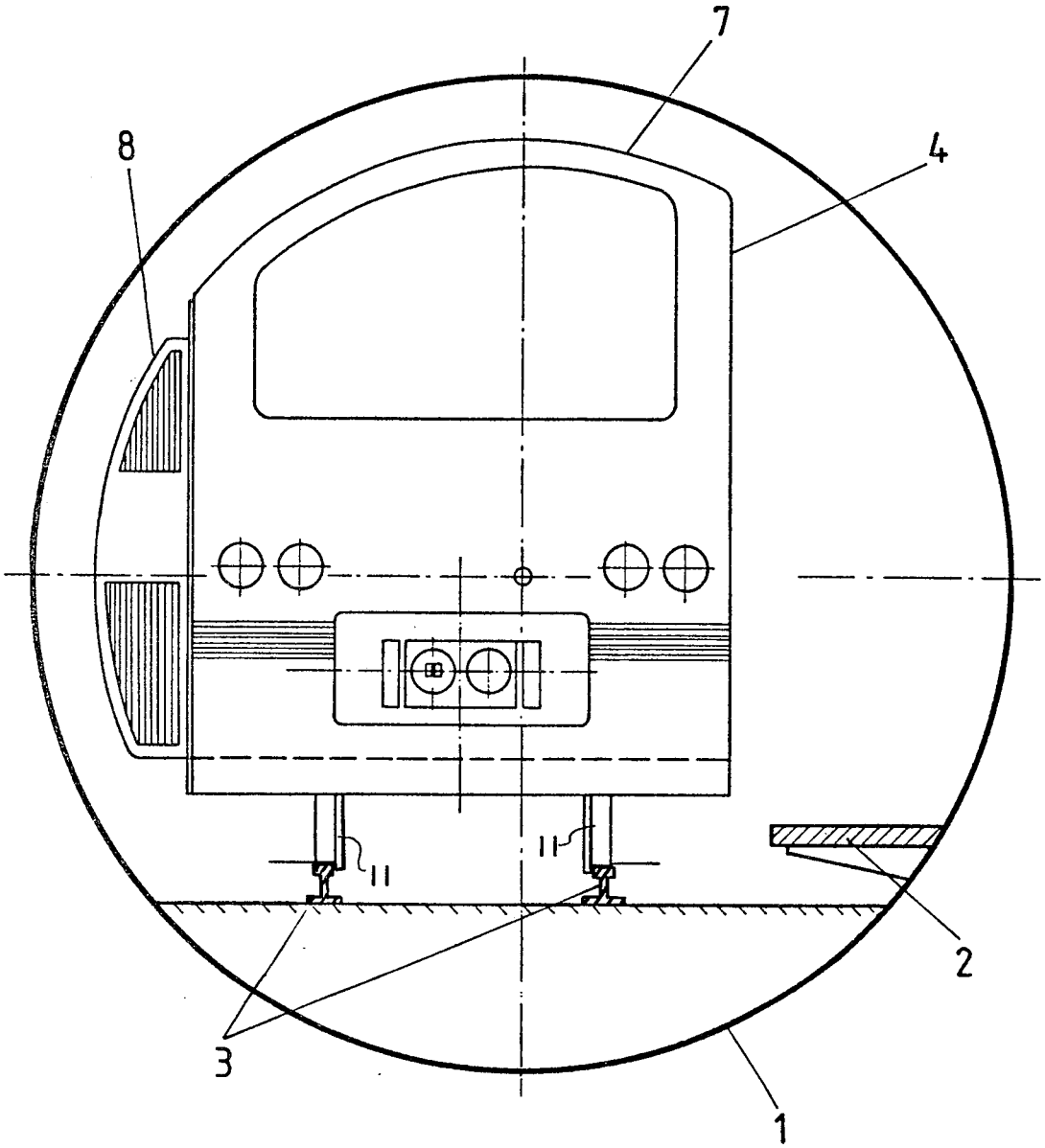
FIG. 3 is a front view of the vehicle shown in FIG. 1.

Referring to the drawings in particular, the invention embodied therein, comprises a subway vehicle, generally designated 20, intended for service in a tunnel or tunnel tube 1. At one longitudinal side of the tunnel tube 1, an excape foot path 2 is provided. The cross-section of the vehicle is conformed to the tunnel tube 1 and to the space left free for the escape path 2. This results in an eccentric arrangement of rails 3 and in an unsymmetrical cross-section of the car. The longitudinal vehicle side 4 facing the foot path preferably extends in the vertical direction. The necessary windows 5 and doors 6 are provided on the longitudinal vehicle side 4. The roof 7 and the longitudinal vehicle side 8 remote from the foot path are advantageously conformable to the cross-section of tunnel tube 1, with the necessary clearance gap. The end portions of the vehicle contain the driver's cabin 9 and spaces 10 for the mechanisms and motors. Driver's cabin 9 and spaces 10 are disposed above the car trucks 11. The zone between car trucks 11 is provided for the passenger space 12. In this zone, the floor 13 of the passenger space 12 is lowered to the necessary minimum above the upper edge of rails 3.

The longitudinal vehicle side 8 which is remote from the escape foot path 2 is designed without windows and doors. In the embodiment of the invention shown, an inner longitudinal side wall 14 of the vehicle also extends in the vertical direction. Side wall 14 carries or supports a structural element or side structure 15, the outside of which is conformed to tunnel tube 1. The side structure 15 contains air ducts or channels for air 16, a duct for heating 17, and a duct for cables 18.

Figure 4:
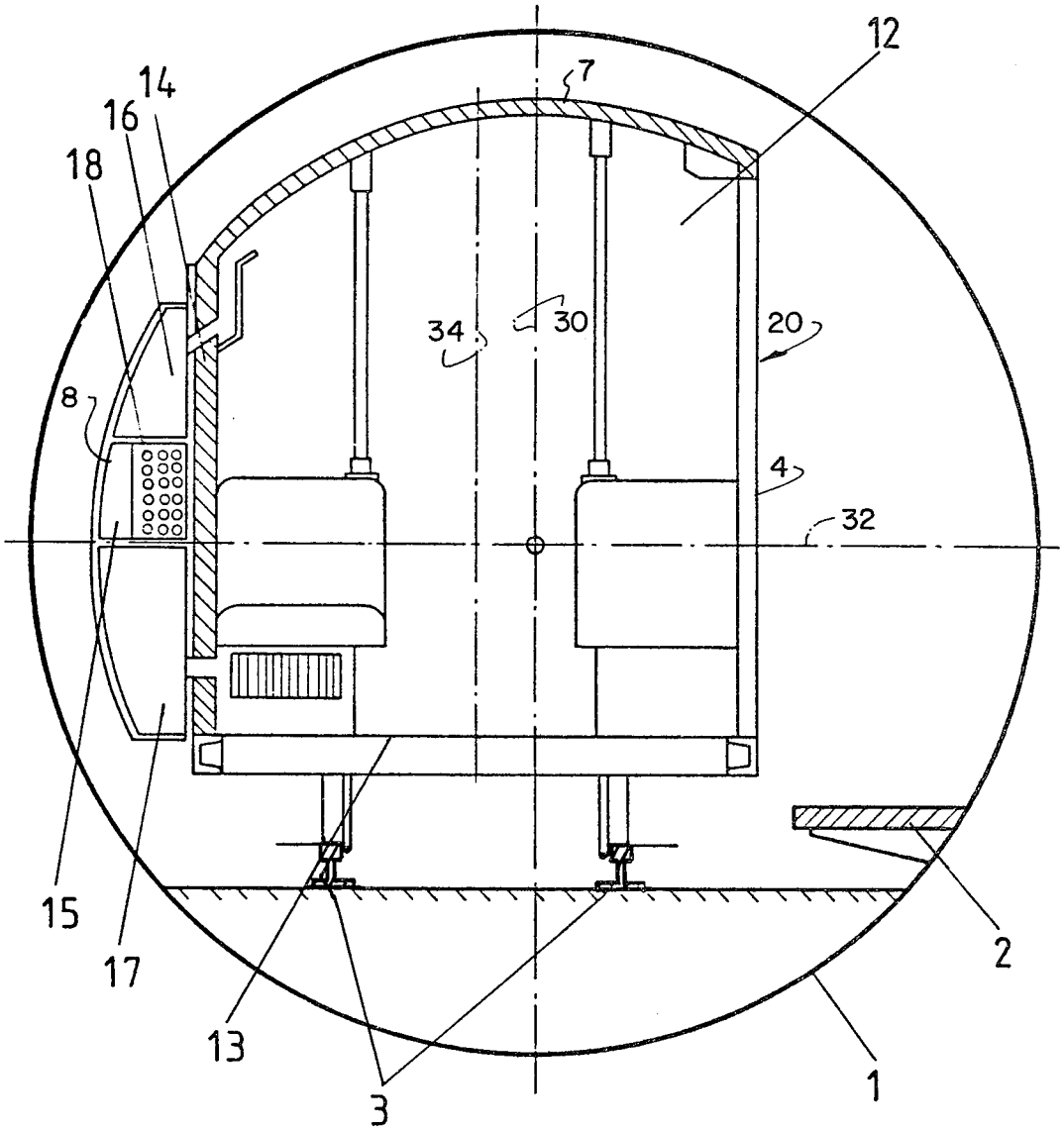
FIG. 4 is a transverse sectional view of the vehicle shown in FIG. 1.

In another embodiment of the invention which has not been shown, a side wall 14' (not shown) of the vehicle is conformed to the shape of tunnel tube 1. In this design, a vertical partition wall is provided within the car body, on the longitudinal side thereof, and an air channel 16, heating channel 17 and cable channel 18 are provided between this partition wall and an outer wall (not shown) of the vehicle positioned the same as wall 14 in FIG. 4.

The vertical center line of the tunnel is designated 30 and the tunnel horizontal centerline is designated 32. The rail car vertical center line is shown at 34.

While a specific embodiment of the invention has been shown and described in detail to illustrate the application of the principles of the invention, it will be understood that the invention may be embodied otherwise without departing from such principles.

What is claimed is:

1. A subway vehicle, for service in a tunnel having a circular cross-section, comprising, a car body of the vehicle having an asymmetrical cross-section and having a first longitudinal side with a vertical side wall, window and door means on said vertical side wall, said car body having an arcuate roof and an opposite second longitudinal side of an arcuate configuration conforming substantially to the configuration of the tunnel, said car body having an inner shorter vertical wall spaced laterally inwardly from said vertical side wall and defining a passenger space between said vertical side wall and said inner shorter vertical wall, and means defining a utility space between said opposite second longitudinal side and said inner shorter vertical wall for accommodating an air and heating and cable duct.

2. A subway vehicle, as claimed in claim 1, wherein said vehicle having said inner wall provides a structural support for said means defining a utility space.

* * * * *